United States Patent [19]

Sells

[11] Patent Number: 4,843,953

[45] Date of Patent: Jul. 4, 1989

[54] VENTILATED CAP FOR THE RIDGE OF A ROOF

[75] Inventor: Gary L. Sells, Mishawaka, Ind.

[73] Assignee: Cor-A-Vent, Inc., Mishawaka, Ind.

[21] Appl. No.: 197,424

[22] Filed: May 20, 1988

[51] Int. Cl.[4] ..... F24F 7/02

[52] U.S. Cl. ..... 98/42.21; 52/43; 52/58; 98/42.22; 98/119

[58] Field of Search ..... 52/43, 58, 60, 97, 302, 52/305, 503, 606, 199; 98/29, 42.2, 42.21, 42.22, 119

[56] References Cited

U.S. PATENT DOCUMENTS

| | | | |
|---|---|---|---|
| 2,214,183 | 9/1940 | Seymour | 98/42.21 X |
| 2,505,147 | 4/1950 | Scallon | 98/29 |
| 2,843,035 | 7/1958 | Jacks | 98/29 |
| 2,905,072 | 9/1959 | Oswald | 98/29 |
| 3,949,657 | 4/1976 | Sells | 98/42.21 |
| 4,545,241 | 10/1985 | Kutsch et al. | 98/42.21 |
| 4,573,291 | 3/1986 | Hofmann | 52/43 |

FOREIGN PATENT DOCUMENTS

| | | | |
|---|---|---|---|
| 628778 | 9/1949 | United Kingdom | 98/42.21 |

*Primary Examiner*—Harold Joyce

*Attorney, Agent, or Firm*—Thomas J. Dodd; James D. Hall; Todd A. Dawson

[57] ABSTRACT

A ventilated cap for use on the ridge of a roof which includes a bevelled flashing for covering a portion of the outer vent openings on the windward side of the ventilated cap to inhibit the ingress of wind driven moisture into the vent openings.

6 Claims, 2 Drawing Sheets

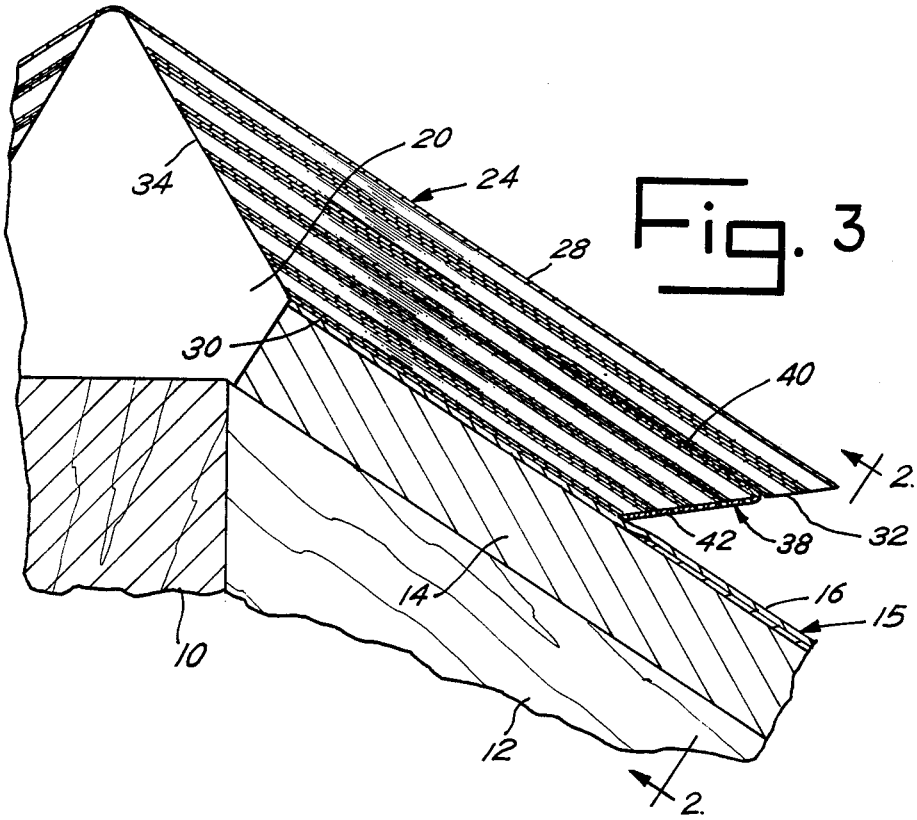
Fig. 3
Fig. 4
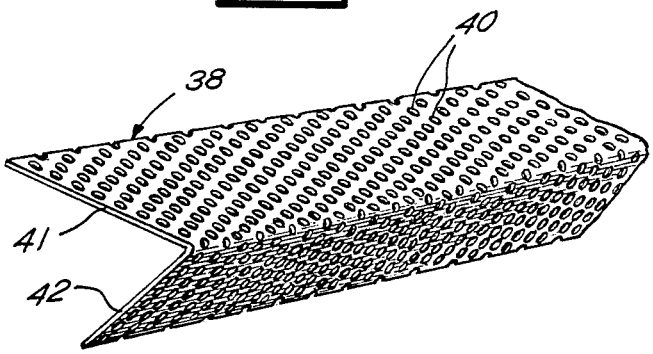

VENTILATED CAP FOR THE RIDGE OF A ROOF

SUMMARY OF THE INVENTION

This invention relates to an improved ventilated cap for the ridge of a roof.

Heretofore, ventilated roof caps have been fabricated from a corrugated material and include a pair of elongated vent parts each having upper and lower surfaces and inner and outer edges which are bevelled and which taper from the top surface to the bottom surface of the part. A plurality of vent openings extend transversely through each vent part from one side edge to the other side edge. The ridge of the roof has a longitudinal opening formed therein and the vent part is located at each side of the ridge opening with its lower edge in contact with the roof. Each vent part inner edge partially overlies the longitudinal vent opening. The two vent halves meet at their inner edges to form an apex in alignment with the longitudinal vent opening. One problem associated with the prior roof caps is that wind driven moisture can sometimes enter the elongated vent parts at the windward side of the cap during severe storms and thereby allow moisture into the roof opening and attic.

The vent cap of this invention eliminates the problem associated with prior vent caps by attaching a flashing strip to the vent openings on the windward side of the vent cap. The flashing is designed to cover either all or a portion of the vent openings to inhibit wind driven moisture from entering the transverse vent openings while maintaining adequate ventilation for the attic area.

Accordingly, it is an object of this invention to provide a ventilated cap for the ridge of a roof.

Another object of this invention is to provide for a ventilated cap for the ridge of a roof wherein moisture is inhibited from entering the vent openings.

Other objects of this invention will become apparent upon a reading of the description below taken with the accompanying drawings.

BRIEF DESCRIPTION OF THE DRAWINGS

FIG. 3 is a fragmentary sectional view taken along line 3—3 of FIG. 1.

FIG. 4 is a fragmentary perspective view of the flashing.

DESCRIPTION OF THE PREFERRED EMBODIMENT

Figure 1:
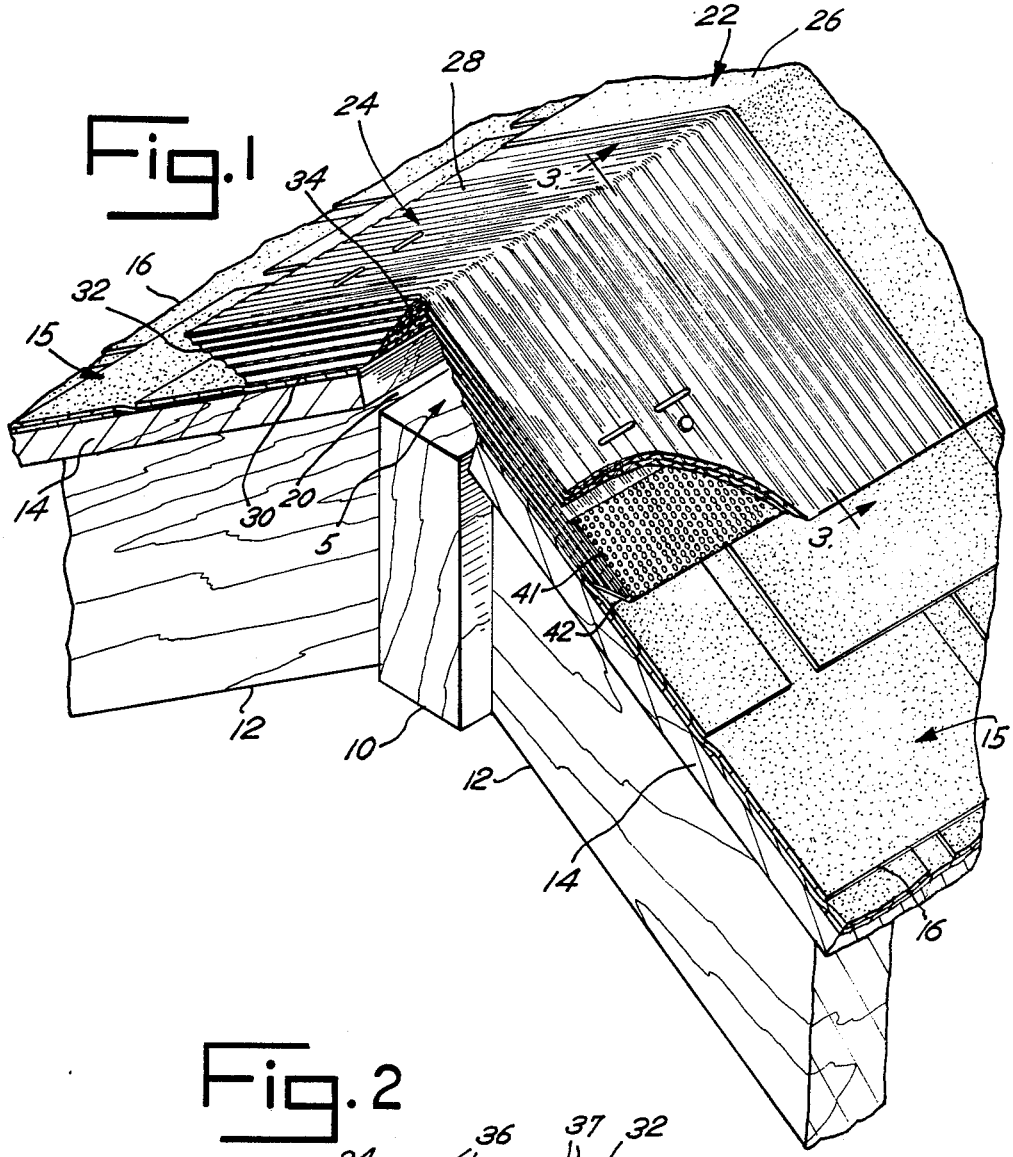
FIG. 1 is a fragmentary perspective view of the vent cap shown in its environment with portions cut away for illustrative purposes.
Figure 2:
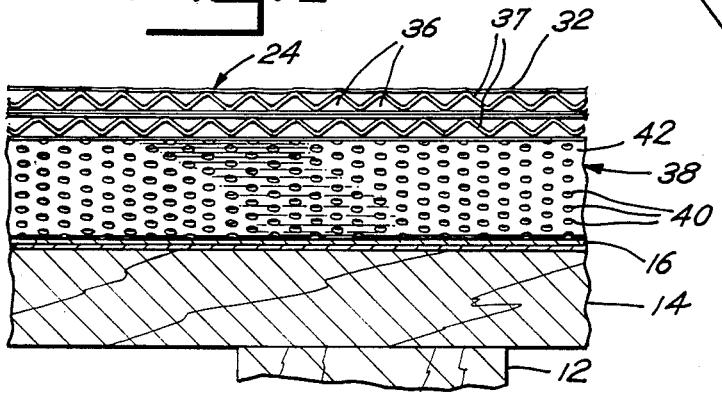
FIG. 2 is a fragmentary end view of the vent cap as seen from line 2—2 of FIG. 3.

The preferred embodiment herein illustrated is not intended to be exhaustive or to limit the invention to the precise form disclosed. It is chosen and described in order to explain the principles of the invention and its application and in practical use to thereby enable others skilled in the art to utilize the invention.

A fragmented portion of a roof is illustrated in the figures. The roof includes a ridge board 10 which is connected to a plurality of longitudinally spaced inclined rafters 12. Roof sheeting 14 covers rafters 12. Shingles 16 are applied over sheeting 14 to form sides 15 of the roof. At the roof ridge 5, sheeting 14 and overlying shingles 16 terminate spacedly from the ridge board 10 so as to provide an opening 20 which extends along each side of ridge board 10 and into the interior of the structure over which the roof is applied.

The ventilated cap 22 of this invention includes a pair of vent parts 24 over which are applied shingles 26. Each vent part 24 includes an upper surface 28, a lower surface 30, an outer side edge 32 and an inner side edge 34. A plurality of openings 36 are formed in vent parts 24 by corrugations 37 which extend from outer side edge 32 to inner side edge 34 of each vent part 24. Openings 36 preferably parallel one of the upper or lower surfaces 28 or 30 of vent parts 24. A more detailed description of vent parts 24 is found in my U.S. Pat. No. 3,949,657, entitled VENTILATED CAP FOR THE RIDGE OF A ROOF, which is incorporated herein by reference.

To prevent the ingress of windblown moisture into openings 36 of vent parts 24, a cover or flashing strip 38 is provided. Flashing strip 38 is shown in the preferred embodiment as being formed from a bent metallic or plastic strip which has perforated holes 40. Holes 40 are large enough to allow for sufficient air flow through the vent parts 24 while small enough to inhibit moisture from entering the vent part under the force of air. In some applications, the flashing strip may be of solid form with no vent holes. Flashing strip 38 includes sides 41 and 42 which meat at an angle equal to the angle between either the upper surface 28 (as shown) or the lower surface 30 and outer side edge 32 of the vent cap. As best illustrated in FIG. 4, side 41 is longer than side 42 which allows the installer the option of either covering all of the windward vent openings 36 or a portion thereof. To cover a portion of vent openings 36, as is illustrated in the figures, the installer places side 42 against outer side edge 32 and wedges side 41 between the corrugated layers of vent parts 24. If, however, the installer desires to cover all vent openings 36 on the windward side of the roof cap, side 41 is positioned against outer side 32 and side 42 of flashing 38 is positioned on upper surface 28 of vent part 24. In either situation, flashing 38 is secured to vent part 24 by an adhesive or bonding agent. Alternatively, the angle between sides 41 and 42 may be obtuse instead of acute as shown with one side being positioned under the corrugated layer of the vent part.

It is to be understood that the invention is not to be limited to the details above given, but may be modified within the scope of the appended claims.

What I claim is:

1. A ventilated cap for the ridge of a roof, said roof having opposed sides tapering upwardly to said ridge, said ridge having a longitudinal opening therein, said cap comprising a pair of elongated vent parts, each vent part having upper and lower surfaces and inner and outer side edges which extend between said surfaces along the longitudinal dimension of the parts, said side edges of each vent part extending from the upper surface to the lower surface of the part, each vent part including multiple layers of corrugated material each defining a plurality of narrow elongated tubular vent openings extending transversely through each vent part thereof from said inner side edge to the outer side edge thereof, a said vent part located on each side of said ridge opening and having the lower surface thereof in contact with a roof side with the vent part generally paralleling said roof side, said vent part upper surfaces overlying said ridge opening, the improvement comprising flashing means for inhibiting ingress of wind driven moisture into said vent openings, said flashing means including first and second side parts which form an angle therebetween substantially equal to one of the angles formed between said outer side edge and said upper surface and said outer side edge and said lower surface of each vent part, said flashing means being connected to a said vent part one of said first and second side parts overlying at least a portion of the outer side edge of the vent part and the other of said first and second side parts extending along said corrugated layers.

2. The cap of claim 1 wherein said first side part is longer than said second side part.

3. The ventilated cap of claim 1 wherein said flashing means has a plurality of openings formed in said first and second side parts.

4. The ventilated cap of claim 1 wherein said other of said first and second side parts overlays at least one of said corrugated layers.

5. The ventilated cap of claim 1 wherein said other of said first and second side part is supported by said corrugated layers.

6. The ventilated cap of claim 1 wherein said other of said first and second side part is positioned between said corrugated layers.

* * * * *